United States Patent [19]

Halls

[11] Patent Number: 4,666,540

[45] Date of Patent: May 19, 1987

[54] METHOD OF REFURBISHING BUILDING PANELS

[75] Inventor: Kenneth F. Halls, Arvada, Colo.

[73] Assignee: Acoustic Industries, Inc., Golden, Colo.

[21] Appl. No.: 707,908

[22] Filed: Mar. 4, 1985

[51] Int. Cl.[4] ..... B32B 35/00

[52] U.S. Cl. ..... 156/98; 52/514; 156/94; 156/256; 181/291; 428/63

[58] Field of Search ..... 29/402.09, 402.11; 156/94, 98, 71, 152, 247, 249, 578, 256; 52/390, 514, 746; 181/291; 264/36; 427/140; 428/63

[56] References Cited

U.S. PATENT DOCUMENTS

| | | | |
|---|---|---|---|
| 1,505,908 | 8/1924 | MacKinnon | 427/196 |
| 2,531,128 | 11/1950 | Hobbs | 156/71 X |
| 2,772,717 | 12/1956 | Ware | 156/551 X |
| 3,092,203 | 6/1963 | Slayter et al. | 156/254 X |
| 3,265,547 | 8/1966 | Selbe | 156/85 |
| 3,788,941 | 1/1974 | Kupits | 156/247 X |
| 4,221,620 | 9/1980 | Milne | 156/152 X |
| 4,500,387 | 2/1985 | Embury | 156/499 |

FOREIGN PATENT DOCUMENTS

| | | | |
|---|---|---|---|
| 113865 | 10/1978 | Japan | 156/94 |

*Primary Examiner*—Robert A. Dawson

*Attorney, Agent, or Firm*—Fields, Lewis, Pittenger & Rost

[57] ABSTRACT

A method and apparatus for on-site repair and refinishing of building panels that have been discolored or worn is provided. In one embodiment, worn acoustical tiles are first removed from their installed location ceiling and worn parts are cut off. Replacement parts are then fitted to the remaining portion of the worn tile and adhesively attached. The repaired tile is then sprayed with adhesive and a sheet of decorative material is attached. Finally, the repaired tile with the decorative material attached is run through pinch rollers, resulting in a neat and secure bonding. The tile is then re-installed in its original location with the decorative material exposed.

In another embodiment, a worn or discolored ceiling tile is removed from the ceiling and placed into a pre-fit, semi-rigid decorative covering. The tile and decorative covering are then replaced in the ceiling in the original position of the tile with the decorative covering exposed.

6 Claims, 12 Drawing Figures

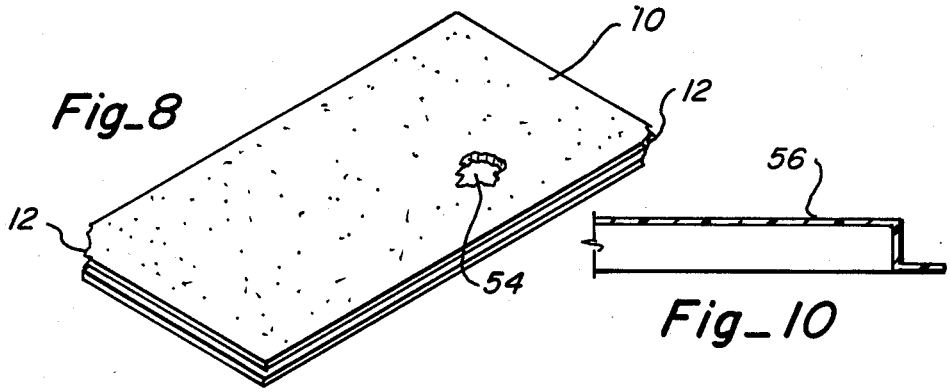
Fig_8
Fig_10
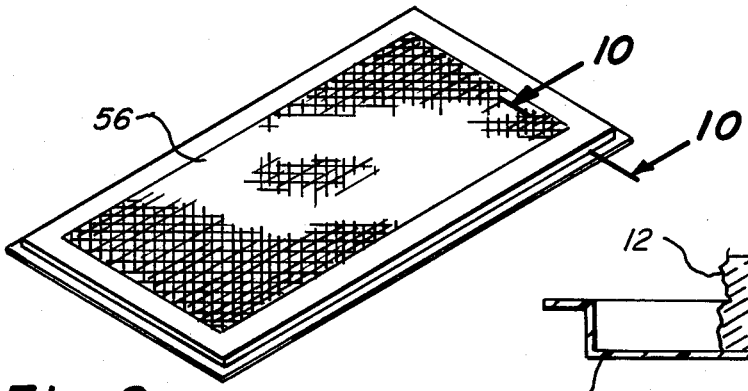
Fig_9
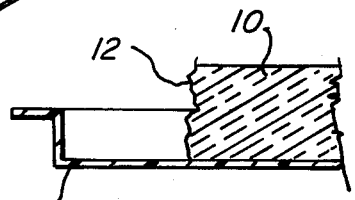
Fig_12
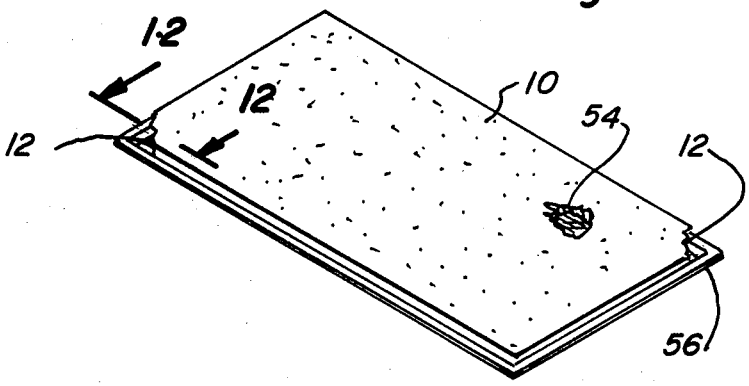
Fig_11

METHOD OF REFURBISHING BUILDING PANELS

TECHNICAL FIELD

This invention relates to a method and apparatus for refurbishing old building panels and more particularly pertains to a method and apparatus for on-site repair and refinishing of conventional acoustical tiles that have been discolored or worn.

BACKGROUND ART

Removable panels and acoustical tiles have long been extensively used, particularly in office and industrial environments. Especially common are panels of mineral fibers for use primarily as ceiling structure, but which are also adaptable for wall coverings or partitions. Such panels are usually very light in weight and have superior sound insulating qualities, particularly when left unattached and free to vibrate.

The lightness and the unattached installation of these panels makes them particularly susceptible to damage and wear in the ordinary course of their use, however. Furthermore, their porousness and typically light color make them vulnerable to discoloration. Once the panels have become worn or discolored, the standard practice has been to replace them with new panels, due to the difficulty of cleaning or repairing them. This can amount to a significant expense in a large environment.

Various methods of covering panels prior to installation are known in the prior art. An apparatus and method for adhering a plastic covering to an acoustical panel is disclosed in U.S. Pat. No. 3,092,203 to Slayter, et al. U.S. Pat. No. 3,265,547 to Selbe discloses a method of applying, by heat, a plastic film having decorative qualities to wall panels, formboard, roof planks, acoustical and decorative tile, plywood panels, and ceiling board. A method of applying adhesive to a wall panel or the like prior to installation is disclosed in U.S. Pat. No. 2,531,128 to Hoelzer, and in U.S. Pat. No. 1,505,908 to MacKinnon.

DISCLOSURE OF THE INVENTION

In accordance with the present invention, a method and apparatus are provided for on-site repairing and refinishing of worn or discolored building panels. In the operation, panels are first removed from their installed location. The panel is then sprayed with an adhesive and covered with a thin sheet of decorative material. Pressure is then applied to the panel, covering, and adhesive, resulting in a neat, secure bond. The repaired and refinished panel is then reinstalled in its original location with the new covering exposed.

More particularly, this invention contemplates neatly cutting off worn corners, cutting replacement corners to fit, and then adhesively attaching the replacement corners to the remaining portion of the panel in place of the worn corners. The invention further contemplates running the panel, covering, and adhesive through pinch rollers to form a secure bond.

In addition, a second method of refinishing worn or discolored panels is provided. After removal of the panels from their original location, the panels are inserted snugly into a prefit decorative covering, then reinstalled.

Based on the foregoing, a number of advantages of the present invention are readily discernable. Panels may be quickly repaired and refinished on-site, at a significant savings over replacement costs. The repaired and refinished panels are aesthetically acceptable, and may even be washed. In addition, the durability of the resulting panel is equal to or superior to that of the original panels.

Additional advantages of this invention will become apparent from the description which follows taken in conjunction with the accompanying drawings.

BRIEF DESCRIPTION OF THE DRAWINGS

FIG. 8 is a perspective view of a ceiling tile having a broken corner and a gouge or hole in its interior;

FIG. 9 is a bottom perspective view of a pre-fit decorative covering for a ceiling tile;

FIG. 10 is a fragmentary cross-sectional view of the decorative covering taken along line 10—10 of FIG. 9;

FIG. 11 is a top perspective view of the ceiling tile of FIG. 8 with the pre-fit decorative covering in place; and FIG. 12 is a fragmentary cross-sectional view of the tile and decorative covering taken along line 12—12 of FIG. 11.

BEST MODE FOR CARRYING OUT THE INVENTION

Figure 1:
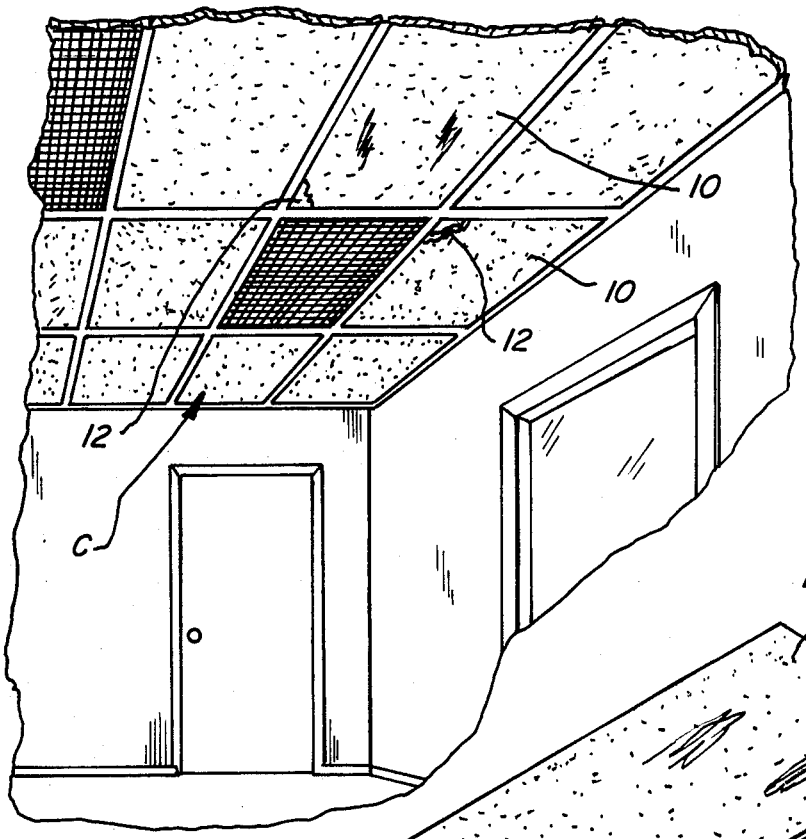
FIG. 1 is a perspective view showing a portion of a ceiling having at least one worn, damaged, or discolored ceiling tile in place.
Figure 2:
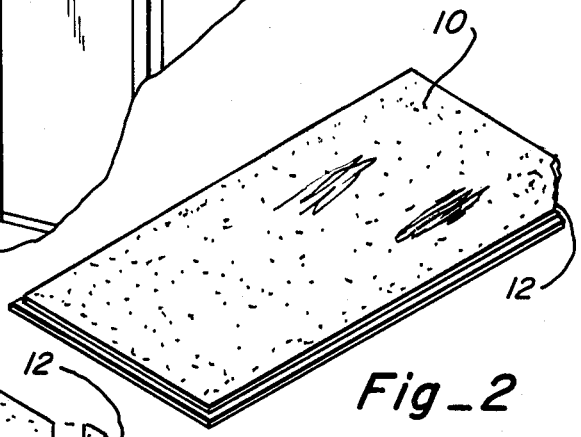
FIG. 2 is a perspective view of a worn ceiling tile after removal from a ceiling.
Figure 3:
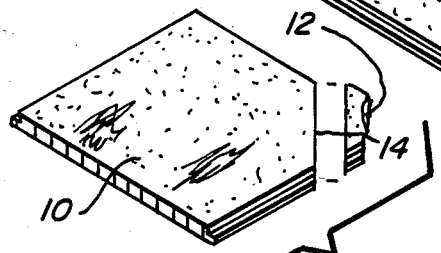
FIG. 3 is a fragmentary perspective view of the removal of a worn corner from a ceiling tile.
Figure 4:
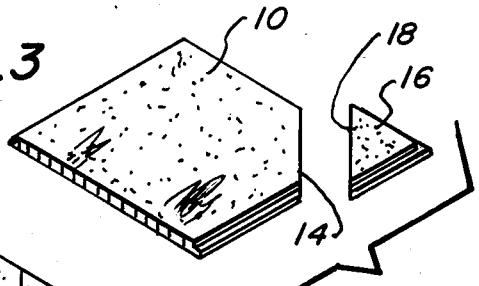
FIG. 4 is a fragmentary perspective view of the fitting of a replacement corner to the worn tile of FIG. 1 whose damaged corner has been removed.
Figure 5:
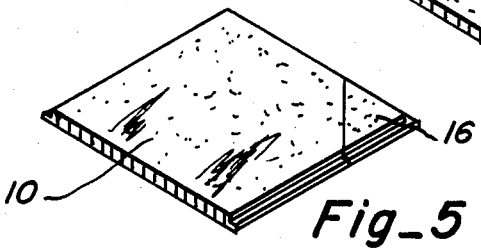
FIG. 5 is a fragmentary perspective view of the combination of the worn tile of FIG. 4 and its replacement corner.

In accordance with one embodiment of this invention, a method is provided for on-site repair and refinishing of conventional ceiling tiles that have been discolored or worn. FIG. 1 depicts several discolored or worn ceiling tiles 10 in place in a ceiling C. The tiles 10 are then removed, as depicted in FIG. 2. As shown in FIG. 3, worn corners 12 are then neatly cut from the tile to form a smooth edge 14. A replacement corner 16, having a corresponding smooth matching edge 18 is then fitted to remaining portion of tile 10 as illustrated in FIG. 4. Once fitted, the replacement corner 16 is adhesively attached to the remaining portion of tile 10. Repaired tile 10 is substantially identical to its original shape, as depicted in FIG. 5. Replacement corners are obtained from spare or unuseable tiles, and may be stockpiled in standard sizes or cut to order.

Figures 6, 7:
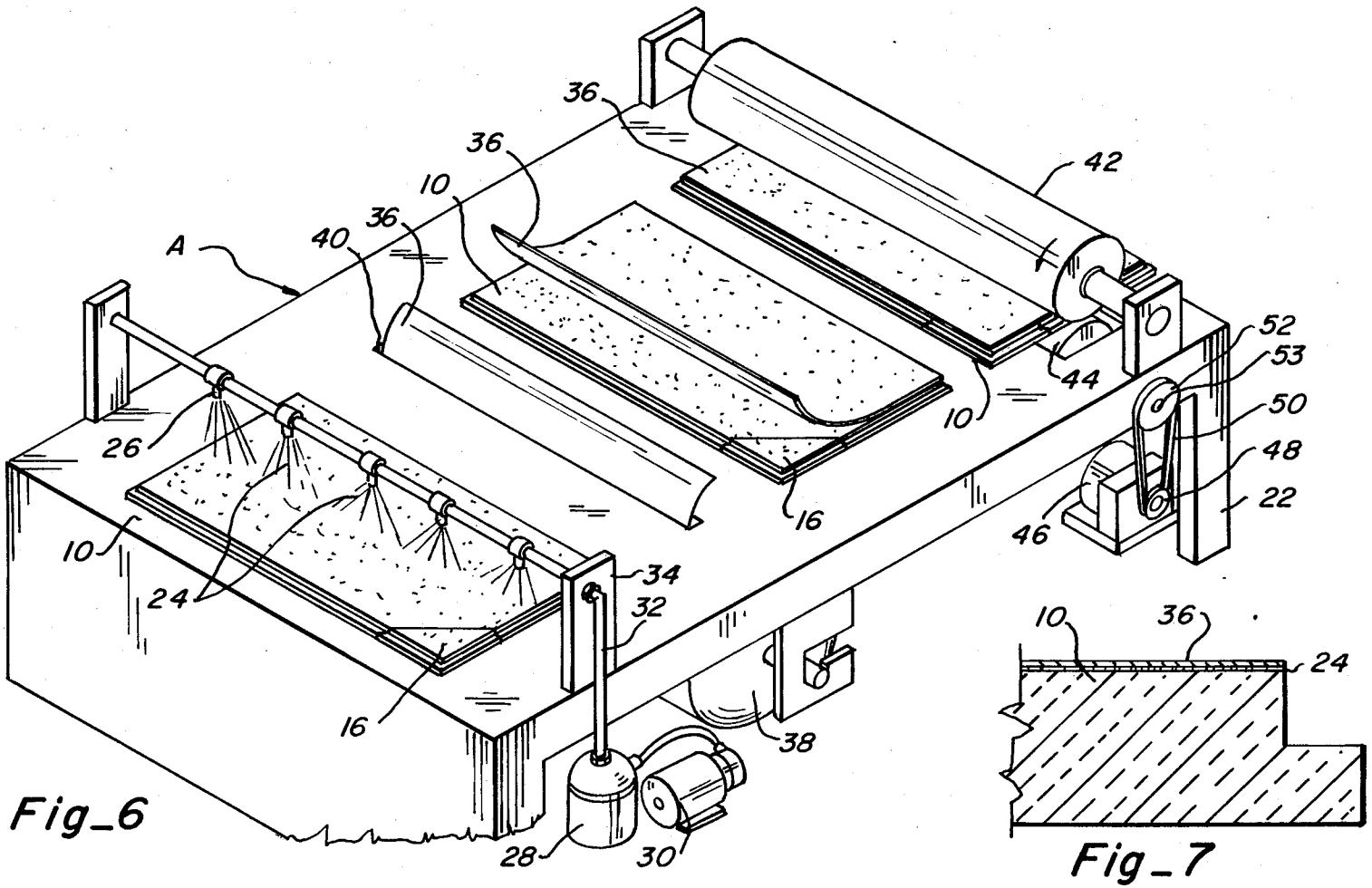
FIG. 6 is a perspective schematic representation of one form of apparatus which may be employed in carrying out the process of covering the tile with a sheet of decorative material.
FIG. 7 is a cross-sectional view of a corner of a repaired and refinished tile of FIG. 1.

Referring now to FIG. 6, an apparatus A is illustrated in a schematic manner for purposes of indicating how several process steps of this invention may be carried out. The repaired tile 10 is depicted moving on a work table 20 supported by standards 22. As the repaired tile 18 moves on the table 20, it is sprayed with a thin layer of adhesive 24 from spray nozzles 26. The adhesive 24 is stored in a reservoir tank 28 from which it is supplied by a pump 30 through pipes 32 supported by vertical supports 34.

Once the repaired tile 10 has been coated with adhesive 24, it is then moved on to be covered by a thin sheet of decorative material 36. The decorative material is dispensed from a roll 38 of such material kept under the work table 20. The decorative material comes up onto the work table 20 through dispensing slot 40, is cut to size, and is attached to the surface of the repaired tile 10.

Once the repaired tile 18 has been covered with a layer of decorative material 36, it is moved on to pinch rollers 42 and 44, where the decorative material 36 is pressed tightly to the repaired tile 10, forming a neat, secure bond, as illustrated in FIG. 7. The pinch rollers 42 and 44 are driven by means of a drive motor 46, with power being transmitted by means of a drive wheel 48, through a pulley belt 50 which causes pulley wheel 52 to rotate shaft 53 of 15 pinch roller 44.

A second embodiment of the invention is depicted in FIGS. 8–12. A damaged ceiling tile 10 is depicted in FIG. 8 having a broken corner 12 and a hole or gouge 54, as shown. A pre-fit decorative covering 56 for the ceiling tile of FIG. 8 is illustrated in FIGS. 9 and 10. After the ceiling tile has been removed from the ceiling and a pre-fit decorative covering has been formed, the tile is inserted into the pre-fit decorative covering 56 as illustrated in FIGS. 11 and 12, and replaced in its original place in the ceiling with the new covering exposed. Preferably, the decorative covering is a semi-rigid, vacuum-formed unit, constructed of vinyl or vinylchloride. Use of the decorative covering obviates the need to repair the tile.

Based on the foregoing description, a number of worthwhile advantages for the present invention are readily apparent. A method and apparatus are provided for on-site repair and refinishing of worn or discolored panels, at a fraction of the cost of replacement of the panels, while at the same time giving aesthetically acceptable results. The process can be performed rapidly, so that disruption of the workplace is minimized. Finally, the resulting repaired panel is as durable or more durable than the original panel, and in fact may even be washed.

The invention has been described in detail with particular reference to a preferred embodiment thereof, but it will be understood that variations and modifications can be effected within the spirit and scope of the invention.

I claim:

1. A method of on-site repairing and refinishing of worn or discolored building panels, comprising the steps of:

removing the panel from its installed location;

placing a new covering over the panel;

cutting worn corners from the panel to form a first smooth edge;

fitting a replacement portion having a second, corresponding smooth matching edge to the remaining portion of the panel;

adhesively attaching the replacement corner to the remaining portion of the panel;

forming a repaired panel substantially identical in shape to the original panel;

cutting a thin sheet of covering material to the size of the panel;

placing an adhesive on a face of the panel;

placing the covering material on said face of said panel, applying pressure to the sheet for bonding the covering sheet to the panel with the adhesive; and re-installing the panel in its original location with the new covering exposed.

2. A method of on-site repairing and refinishing of worn or discolored building panels, comprising the steps of:

removing the panel from its installed location;

placing a new covering over the panel;

cutting worn corners from the panel to form a first smooth edge;

fitting a replacement portion having a second, corresponding smooth matching edge to the remaining corner of the panel;

adhesively attaching the replacement portion to the remaining portion of the panel;

forming a repaired panel substantially identical in shape to the original panel;

cutting a thin sheet of covering material to the size of the panel;

placing an adhesive on a face of the pane;

placing the covering material on said face of said panel rolling the panel and the covering through pressure rollers for bonding the covering sheet to the panel with the adhesive; and re-installing the panel in its original location.

3. The method, as claimed in claim 2, wherein said building panel is an acoustical tile.

4. A method of refinishing worn or discolored building panels, comprising the steps of:

removing the panel from its installed location;

forming a pre-fit, semi-rigid decorative covering;

inserting the panel into the decorative covering; and re-installing the panel in its original location with the decorative covering exposed.

5. The method, as claimed in claim 4, wherein said decorative covering is a vacuum-formed vinyl or vinylchloride unit.

6. The method, as claimed in claim 5, wherein said building panel is an acoustical tile.

* * * * *